US006690332B1

(12) United States Patent
Eckersten et al.

(10) Patent No.: US 6,690,332 B1
(45) Date of Patent: Feb. 10, 2004

(54) ANTENNA METHOD AND DEVICE WITH PREDICTIVE SCAN POSITION

(75) Inventors: Christer Eckersten, Jarfalla (SE); Ingvar Backestrand, Kista (SE)

(73) Assignee: SaabTech Electronics AB (SE)

( * ) Notice: Subject to any disclaimer, the term of this patent is extended or adjusted under 35 U.S.C. 154(b) by 0 days.

(21) Appl. No.: 09/959,205

(22) PCT Filed: Apr. 12, 2000

(86) PCT No.: PCT/SE00/00699

§ 371 (c)(1),
(2), (4) Date: Jan. 22, 2002

(87) PCT Pub. No.: WO00/65370

PCT Pub. Date: Nov. 2, 2000

(30) Foreign Application Priority Data

Apr. 22, 1999 (SE) ..... 9901444

(51) Int. Cl.[7] ..... H01Q 3/00

(52) U.S. Cl. ..... 343/757; 343/755; 343/761; 343/763

(58) Field of Search ..... 343/755, 757, 343/759, 761, 763, 781 CA, 781 P, 765, 766, 839

(56) References Cited

U.S. PATENT DOCUMENTS 4,253,100 A * 2/1981 Commault et al. ..... 343/756
5,194,874 A * 3/1993 Perrotta ..... 343/757
5,198,827 A * 3/1993 Seaton ..... 343/761
5,526,008 A * 6/1996 Meserole et al. ..... 343/761
6,293,027 B1 * 9/2001 Elliott et al. ..... 33/546
6,492,955 B1 * 12/2002 Amyotte et al. ..... 343/781 P

FOREIGN PATENT DOCUMENTS

| | | |
|---|---|---|
| GB | 1 348 706 | 3/1974 |
| GB | 1 437 298 | 5/1976 |
| JP | 56-35073 A | 4/1981 |
| SE | 505 599 | 11/1996 |

* cited by examiner

*Primary Examiner*—Tan Ho
(74) *Attorney, Agent, or Firm*—Connolly Bove Lodge & Hutz LLP; Larry J. Hume

(57) ABSTRACT

In one embodiment, an antenna device includes a scanning reflector, a fixed feeder interacting with the reflector for emitting radar radiation and a detector for detecting reflector passage of at least two different predetermined scanning positions during scanning of the reflector. The antenna device also includes a timer used to determine passage times at the time of reflector passage of the scanning positions. The scanning position of the reflector is predicted at an arbitrary time on the basis of the passage times and a predetermined scanning motion of the reflector. In another embodiment, a method for determining an accurate scanning position for the scanning reflector of the antenna device is disclosed.

20 Claims, 2 Drawing Sheets

ANTENNA METHOD AND DEVICE WITH PREDICTIVE SCAN POSITION

TECHNICAL FIELD

This invention relates to an antenna device comprising a scanning reflector and a fixed feeder interacting with the reflector for emitting radar radiation.

TECHNICAL BACKGROUND

In such an antenna device the scanning position, or scanning angle, needs to be accurately determined in order to be able to determine the lateral position of detected objects. For example, when provided in a car radar apparatus it is necessary to determine in what lane a detected obstacle is.

A known device, that could be used in the above antenna device, for detecting the scanning position at a high accuracy is a resolver sensor. A resolver sensor comprises two coils positioned at right angles in a magnetic field. The distribution of the magnetic field on the two coils is detected and used as a measure of the scanning position. However, the construction of this resolver sensor is complex rendering the sensor expensive. This is particularly a drawback when applied in a car radar apparatus.

SUMMARY OF THE INVENTION

An object of the present invention is to provide an antenna device having a simple low cost yet accurate determination of the scanning position of the reflector; and a method for performing said determination.

The object is achieved by an antenna device and a method according to the enclosed claims.

In one aspect thereof, the invention relates to an antenna device comprising a scanning reflector, a fixed feeder interacting with the reflector for emitting radar radiation and a detector for detecting reflector passage of at least two different predetermined scanning positions during scanning of the reflector. The antenna device further comprises timing means for determining passage times at said passages, and prediction means for predicting the scanning position of the reflector at an arbitrary time on basis of said passage times and a predetermined scanning motion of said reflector.

In another aspect thereof, the invention relates to a method for determining an scanning position for the scanning reflector of the above described antenna device. The method comprises the steps of:

- measuring passage times for the reflector, during reflector scanning, passing at least two predetermined and spaced scanning positions;
- predicting the scanning position of the reflector at an arbitrary time by means of said passage times and a predetermined scanning motion of said reflector.

In accordance with the present invention, by arranging for the measurement of passage times, at two or more spaced predetermined scanning positions, accurate relationships between position and time are established. The scanning reflector of the antenna is operated in a predetermined way as regards the motion thereof. Consequently, the momentary position of the reflector is theoretically known. However, due to mechanical and other deviations a degree of inaccuracy exists in practice. The invention substantially reduces that inaccuracy. By means of said theoretically known movement and the actual and precise time measurements at the predetermined, and accurately known, passage positions accurate predictions of scanning position at arbitrary times are enabled. By the expression arbitrary times is to be understood other points of time than the measured passage times.

Further objects and advantages of the present invention will be discussed below by means of exemplary embodiments.

DETAILED DESCRIPTION OF EMBODIMENTS

Figure 1:
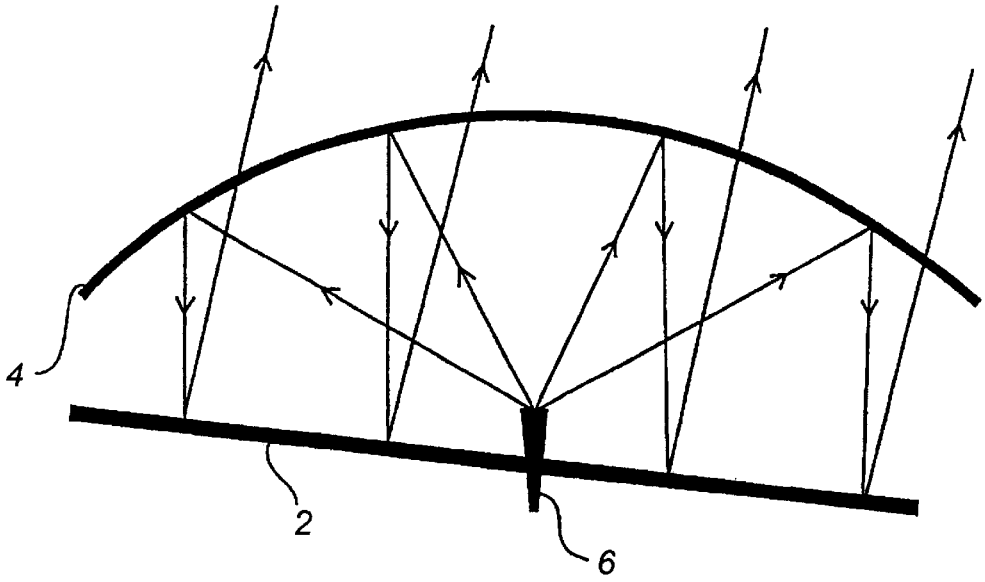
FIG. 1 shows schematically, in top view an example of an antenna device of the type having a scanning reflector.
Figure 2:
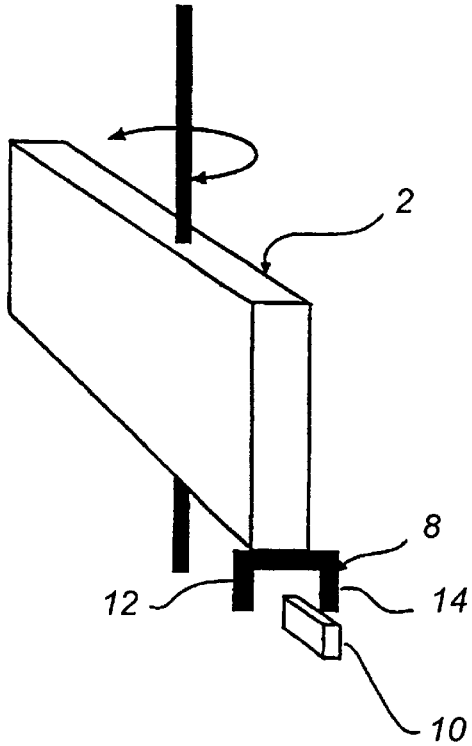
FIG. 2 shows schematically, in perspective view, an example of a scanning reflector as shown in FIG. 1 provided with a detection device according to an embodiment of the invention.

As shown in FIG. 1, in a preferred embodiment an antenna device comprises a scanning reflector, or main reflector 2, a fixed subreflector 4 and a fixed feeder 6 interacting with the reflectors 2 and 4 for emitting radar radiation. The radar radiation originated from the feeder 6 has a vertical polarisation and is subjected to a first reflection by the subrecflector 4, reflecting the radiation towards the main reflector 2. Then, the radiation is subjected to a second reflection by the main reflector 2, which additionally turns the radiation into a horizontal polarisation. Subsequently, the horizontally polarised radiation is emitted from the antenna device, since the subreflector 4 is transparent to horizontally polarised radiation.

The main reflector 2 scans reciprocatingly, i.e. it scans back and forth turning about a central axis, which is positioned at the centre of the feeder 6. This antenna device construction is attractive since, when turning the main reflector by an angle $\nu$ the emitted radiation is turned by twice that angle, i.e. $2\nu$. Further, the mass of the moving parts is small.

Figure 3:
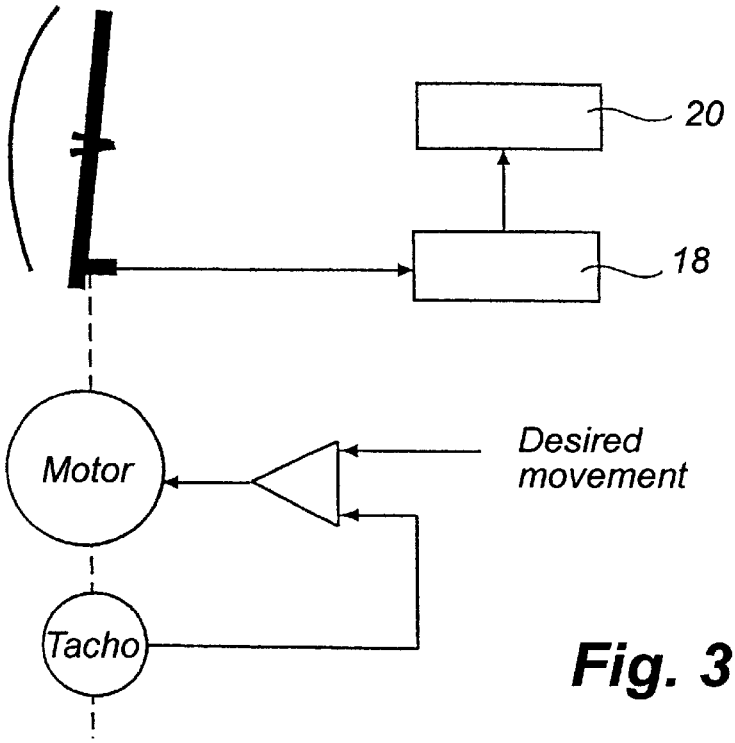
FIG. 3 shows a schematic diagram of circuitry for operation and control comprised in an embodiment of the present invention.

Further, the antenna device comprises servo means, as illustrated in FIG. 3, for the scanning operation of the main reflector 2. Said servo means may, for example, comprise a motor, a tachometer, etc., as disclosed in Swedish patent No. 9501706-7 and schematically indicated in FIG. 3.

In order to be able to determine the scanning position of the main reflector 2 at any point of time, in accordance with this invention the antenna device is provided with a detector for detecting reflector passage of at least two different predetermined scanning positions during scanning of the main reflector 2. The detector comprises activator means 8 and sensor means 10. The activator means 8 is arranged on the main reflector 2 and spaced from the central axis thereof, and is constituted by a fork shaped magnetic element 8 having first and second spaced protrusions 12, 14. The sensor means, or sensor, 10 is fixedly positioned in the antenna device. More particularly, the sensor 10 is arranged below the main reflector 2 and offset from the central axis thereof so that the magnetic element 8 passes the sensor 10 during the scanning. Preferably, the sensor 10 is constituted by a Hall element 10. The Hall element 10 is connected to timing means 18 for determining passage times at said passages. The timing means is further connected to prediction means 20 for predicting the scanning position of the main reflector 2 at an arbitrary time, i.e. at any time but the passage times the positions of which are known. The timing means 18 comprises conventional circuits such as counters, etc., needed for performing the tasks described herein. The implementation of the timing means 18 will be obvious for one skilled in the art and is, consequently, not disclosed in detail. This applies to the prediction means 20 as well. That is, the implementation of the circuits of the prediction means 20 for performing the prediction calculations will be evident for one skilled in the art.

Figure 4:
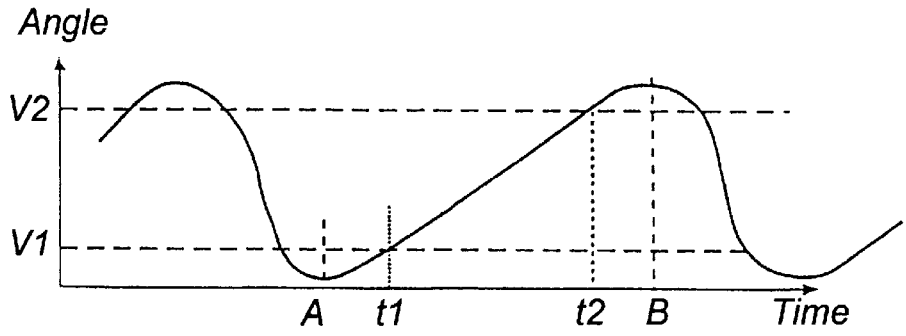
FIG. 4 shows a diagram of a typical movement of the scanning reflector.

As is evident from FIG. 4, the main reflector 2 scans forth at a lower speed and substantially linearly, while it scans back at a higher speed but rather nonlinearly. Below, the substantially linear movement will be referred to as the primary sweep and the nonlinear movement will be referred to as the secondary sweep. Of course, in the vicinity of the turning points, denoted A and B in FIG. 4, no one of the sweeps is linear.

When the main reflector 2 is scanning, the protrusions 12, 14 passes the Hall element 10 one at a time. At every passage, the protrusion 12 or 14 activates the Hall (element 10, which in turn generates a sensor signal that is input to the timing means 18. The timing means 18 determines two different passage times $t_1$ and $t_2$ respectively, at which the two sensor signals are received by the timing means 18 during a primary sweep. The passage times $t_1$ and $t_2$ are then stored and used by the prediction means 20 for determining the scanning position, i.e. the scanning angle, of the main reflector 2 at an arbitrary time. The space between the protrusions 12, 14 is preferably related to the distance covered by them during a primary sweep such that the passage positions, and consequently the passage times $t_1$ and $t_2$, are well within the portion of the primary sweep assumed to be linear. Thus, the portion of the primary sweep between the passage times $t_1$ and $t_2$ as well as a portion beyond each of the passage times $t_1$ and $t_2$ are considered linear. Accordingly, the determinations of the scanning angles for arbitrary times within the linear portion of the primary sweep are based on the assumption of a predetermined linear scanning movement. Thus, the momentary angle v at the arbitrary time t is determined by means of the following equation:

$$v(t) = \frac{v1 * (t2 - t) + v2 * (t - t1)}{t2 - t1}$$

where v1 and v2 are the scanning angles at the passages, and, thus, at the passage times $t_1$ and $t_2$ respectively.

In the illustrated example, the primary sweep is centred in relation to the positions of passage of the Hall element 10. In other words, the time period from the first turning point A to the first passage time $t_1$ equals the time period from the second passage time $t_2$ to the second turning point B. However, this does not have to be the case. The primary sweep may be offset as well, e.g. in order to compensate for an inaccurate mounting of the antenna device. Such an offset is allowed due to the above described choice of relation locating the passage times well within the linear portion of the primary sweep.

Above a preferred embodiment of the present invention has been described. This should be seen as merely a non-limiting example. Many modifications will be possible within the scope of the invention as defined by the claims. Below a few examples of such modifications will be given.

It is not necessary for the movement to be linear to permit a prediction of the scanning position. For example, it could be approximately sinusoidal etc. However, the movement has to be predetermined in order to enable an accurate prediction of the angle of the main reflector at an arbitrary time. Consequently, it would be possible to predict scanning positions during the above secondary sweep as well, which, by the way, is done in alternative embodiments of the present invention.

Several different detector arrangements are employable. In one alternative, two separate activating elements are used, one at each side of the central axis of the main reflector, a separate sensor being associated with each of said activating elements. In another alternative, two spaced sensors and an activator having merely one activating portion is used. The activator and the sensor may change places. Other types than magnetically alerted detectors can be used. However, the arrangement of the above described embodiment is preferred due to the simple and reliable function and cost effectiveness thereof.

In other modified embodiments, more than two passage times are generated in order to further increase the accuracy of the prediction of the angle. However, this is to the cost of complexity. Consequently, the above described embodiment generating two passage times is preferred. Due to a stable control of the movement of the main reflector, which control is achieved by the above described motor-tachometer device, the predictions are accurate enough though based on merely two passage times.

The applicability of the invention is not limited to the type of antenna described above, but it is applicable to all types of antennas having a scanning reflector.

What is claimed is:

1. An antenna device comprising:

a scanning reflector and a fixed feeder interacting with the reflector for emitting radar radiation;

a detector for detecting reflector passage of at least two different predetermined scanning positions during scanning of the reflector;

timing means for determining passage times at said at least two different predetermined scanning positions; and prediction means for predicting the scanning position of the reflector at an arbitrary time on the basis of said passage times and a pre-determined scanning motion of said reflector.

2. An antenna device according to claim 1, wherein said detector comprises activator means and sensor means, said reflector being provided with said activator means and said sensor means being fixedly positioned and coupled to the timing means, said activator means activating said sensor means at said predetermined scanning positions.

3. An antenna device according to claim 2, wherein said activator means comprises at least two spaced magnetic protrusions and wherein said sensor means is magnetically sensitive.

4. An antenna device according to claim 3, wherein said sensor means is arranged below the reflector and offset from a central axis thereof so that a portion of the reflector provided with the activator means passes the sensor during the scanning.

5. An antenna device according to claim 3, wherein said sensor means comprises a Hall element.

6. An antenna device according to claim 3, wherein said predetermined scanning motion is linear at least during a portion of a sweep, said portion embracing reflector passage of at least two consecutive predetermined scaning positions.

7. An antenna device according to claim 2, wherein said predetermined scaring motion is linear at least during a portion of a sweep, said portion embracing reflector passage of at least two consecutive predetermined scanning positions.

8. An antenna device according to claim 2, wherein said sensor means is arranged below the reflector and offset from a central axis thereof so that a portion of the reflector provided with the activator means passes the sensor during the scanning.

9. An antenna device according to claim 8, wherein said sensor means comprises a Hall element.

10. An antenna device according to claim 8, wherein said predetermined scanning motion is linear at least during a portion of a sweep, said portion embracing reflector passage of at least two consecutive predetermined scanning positions.

11. An antenna device according to claim 2, wherein said sensor means comprises a Hall element.

12. An antenna device according to claim 11, wherein said predetermined scanning motion is linear at least during a portion of a sweep, said portion embracing reflector passage of at least two consecutive predetermined scanning positions.

13. An antenna device according to claim 1, wherein said predetermined scanning motion is linear at least during a portion of a sweep, said portion embracing reflector passage of at least two consecutive predetermined scanning positions.

14. An antenna device according to claim 13, wherein said at least two consecutive scanning positions are well within the linear portion of the sweep, thereby permitting compensation for an oblique mounting of the antenna device by offsetting the sweep while keeping said at least two consecutive scanning positions within the linear portion of the sweep.

15. A method for determining a scanning position for a scanning reflector of an antenna device, which includes a fixed feeder interacting with said reflector for emitting radar radiation, the method comprising:

measuring passage times for the reflector, during reflector scanning, passing at least two predetermined and spaced scanning positions; and predicting the scanning position of the reflector at an arbitrary time by means of said passage times and a predetermined scanning motion of said reflector.

16. A method according to claim 15, further comprising detecting the passage of said predetermined scanning positions by activating a sensor means by way of an activator means provided at a portion of the reflector.

17. A method according to claim 16, further comprising magnetically activating said sensor means.

18. A method according to claim 16, further comprising driving the reflector linearly at least during a portion of a sweep, said portion embracing reflector passage of at least two consecutive predetermined scanning positions.

19. A method according to claim 15, comprising driving the reflector linearly at least during a portion of a sweep, said portion embracing reflector passage of at least two consecutive predetermined scanning positions.

20. A method according to claim 19, wherein said at least two consecutive scanning positions are well within the linear portion of the sweep, thereby permitting compensation for an oblique mounting of the antenna device by offsetting the sweep while keeping said at least two consecutive predetermined scanning positions within the linear portion of the sweep.

* * * * *